US007922426B2

(12) United States Patent
Thomson

(10) Patent No.: US 7,922,426 B2
(45) Date of Patent: Apr. 12, 2011

(54) TIE LINKING FILLED SANDBAGS AND USE IN A BARRIER FORMED FROM FILLED SANDBAGS

(75) Inventor: Ian Robert Thomson, St Neots Cambridgeshire (GB)

(73) Assignee: Saratoga Technologies Limited (GB)

( * ) Notice: Subject to any disclaimer, the term of this patent is extended or adjusted under 35 U.S.C. 154(b) by 0 days.

(21) Appl. No.: 11/576,466

(22) PCT Filed: Sep. 28, 2005

(86) PCT No.: PCT/GB2005/050165

§ 371 (c)(1),
(2), (4) Date: Jun. 28, 2007

(87) PCT Pub. No.: WO2006/038038

PCT Pub. Date: Apr. 13, 2006

(65) Prior Publication Data

US 2007/0269141 A1 Nov. 22, 2007

(30) Foreign Application Priority Data

Oct. 2, 2004 (GB) ..... 0421866.5

(51) Int. Cl.
*E02D 29/02* (2006.01)

(52) U.S. Cl. ..... 405/284

(58) Field of Classification Search ..... 405/284, 405/302.4, 302.6, 302.7; 52/715, 642, 633, 52/489.2

See application file for complete search history.

(56) References Cited

U.S. PATENT DOCUMENTS

| | | | | |
|---|---|---|---|---|
| 3,922,832 | A | 12/1975 | Dicker et al. | |
| 4,486,115 | A * | 12/1984 | Rionda et al. | 403/283 |
| 4,779,393 | A * | 10/1988 | Jong | 52/715 |
| 5,934,027 | A | 8/1999 | Khalili et al. | |
| 6,364,374 | B1 * | 4/2002 | Noone et al. | 285/424 |
| 6,412,246 | B1 * | 7/2002 | Tadich | 52/633 |

FOREIGN PATENT DOCUMENTS

| | | | |
|---|---|---|---|
| DE | 8702655 | U1 | 6/1987 |
| DE | 10246582 | | 4/2004 |
| EP | 1171668 | * | 10/2000 |
| GB | 2259528 | | 3/1993 |
| GB | 2326428 | A | 12/1998 |
| WO | 0061880 | | 10/2000 |

* cited by examiner

*Primary Examiner* — David J Bagnell
*Assistant Examiner* — Benjamin Fiorello
(74) *Attorney, Agent, or Firm* — Brooks Kushman P.C.

(57) ABSTRACT

Barriers for flood defense and other purposes are often constructed using sand bags. The strength of these barriers is limited and the invention seeks to address this problem. The invention provides a tie formed as a single injection molded item placed between layers of sandbags to help to hold them together. The tie has two rigid triangular end plates (4) and (5) linked by a flexible arm (11). The end plates are formed with protruding spikes (6) shaped with a barb so that they will easily penetrate the fabric of a sandbag but are difficult to pull out. In use, each tie is placed between layers of sandbags so that spikes of respective plates (4) and (5) become anchored to adjoining bags. The bags of the barrier are thus held together and any irregularities in it are accommodated by the flexibility of the arm (11). Slots (14) and lugs (15) allow a plurality of ties to be linked together as may be required when oversize sandbags are employed.

9 Claims, 4 Drawing Sheets

TIE LINKING FILLED SANDBAGS AND USE IN A BARRIER FORMED FROM FILLED SANDBAGS

This invention relates to the construction of walls and barriers, particularly from bags or sacks filled with sand or other particulate material. Such barriers are highly effective for emergency flood defence operations, in military environments for protection against enemy gunfire, for containing the effects of controlled explosions, to protect spectators in motor-sport events and for many other purposes.

The bags are normally made from woven material such as hessian or synthetic plastics and are filled with sand or any other granular material that can be obtained locally, where the barrier is to be constructed. Sometimes bags are filled with a sand/cement mixture for the construction of underwater barriers. This invention has a potential to be useful in any of the above environments.

Barriers constructed from filled bags can be very effective and quickly constructed. However, being formed from separate units, not connected together, the strength of the barrier is limited. Even bags filled with a sand/cement mixture for underwater use suffer from this weakness and can collapse before the cement has set. The invention was made when considering how the strength of these barriers could be improved whilst still retaining the benefit of speed of construction.

It has been proposed, in patent specification U.S. Pat. No. 5,934,027, to use barbed wire between layers of sandbags to stabilise the structure but this technique, whilst helpful, is of limited effectiveness because the barbed wire does not grip well onto the bags.

Furthermore, barbed wire is difficult to handle and is so flexible in all directions that it fails to give sufficient support for many situations.

Another proposal, described in patent specification WO 00/61880 involves the use of spiked plates between the sandbags. This technique could be effective in situations where the ground is perfectly flat and the filled bags can all be guaranteed to be of equal size and shape. However the plates described in that specification would be effective only in situations where adjacent bags lie in truly regular and uniform lines.

Another proposal for solving the problem is described in patent specification DE 10246582 which describes an arrangement in which strands are attached to the bags and tied together to help to prevent the bags from separating. This technique could be some assistance. However, connecting the strands together would waste valuable time in an emergency situation. Also, inevitable slackness of the strands would allow initial displacement of the bags without restraint, until the strands have become taught. Another disadvantage is that specially made bags are needed.

Yet another previous attempt to address the problem is described in patent specification GB2326428 which describes a system in which straps are wrapped around an entire wall of sandbags and drawn tight to hold them together. This technique would appear to be applicable only to special bags which have a defined rectilinear shape and where the intention is to construct a permanent or semi-permanent structure in a non-emergency situation.

According to a first aspect of this invention there is provided a barrier formed from filled bags stacked one on top of another and ties having pointed projections for holding the bags together to strengthen the barrier; characterised in that the ties have relatively rigid, spiked, bag-retention members arranged to engage respective sandbags and a relatively flexible connector joining the spiked retention members.

The invention thus can be used to give the benefits of a device like that described in patent specification WO 00/61880 whilst allowing the flexibility required to accommodate imperfect regularity of alignment of the sandbags.

Each tie preferably has spikes facing both up and down and is best positioned so that it bridges adjoining bags. When other bags have been placed on top of it, the weight of the bags presses the spikes through the fabric.

In an alternative construction, the ties are permanently attached to, or are integrally formed with, the bags. For example, panels or strips, formed with appropriate spikes, could be permanently attached by stitching, stapling or adhesive to the bags. However this variation is not preferred because it requires special-purpose bags.

To obtain the required degree of flexibility, the tie preferably takes the form of two spiked panels or plates joined by a relatively thin and therefore flexible stem. Thus, according to a second aspect of the invention there is provided a tie for reinforcing a barrier formed from stacked building units (eg filled bags) characterised in that the tie comprises two plates joined by a flexible connector, each plate having projections extending from opposite faces.

Expressed a different way the invention provides a tie for linking individual building units forming a wall or barrier and characterised in that the tie has two relatively broad and rigid end parts carrying spikes for anchoring into adjacent building material; and a relatively narrow and flexible connector that joins the end parts.

The panels or plates and linking connector can all be defined by a single moulded product of synthetic plastics material though it would be possible to use metal, or a combination of different materials. For example, an effective alternative construction could be made from metal spiked plates crimped onto opposite ends of a short length of nylon cord.

The spikes ate preferably barbed so that removal from the fabric of a sand bag is more difficult than penetration. An appropriate barb can easily be formed as part of a moulding process if the tie is made from synthetic plastics material.

There are sometimes situations where larger than normal sandbags are used and where a tie of standard size would not be appropriate. For this reason, the tie is preferably designed so that it an can easily be attached to a similar tie so as to extend its length and/or breadth. In this way it becomes possible to connect together a large number of ties to form a line or network of connectors between the sandbags.

Thus, according to yet another aspect of this invention there is provided a tie for linking individual building units forming a wall or barrier, the tie defining spikes for anchoring into adjacent material of the wall or barrier characterised in that the tie is designed to interlink with adjoining similar ties to form a larger tie.

An example of one way of implementing the invention will now be described by way of example with reference to the accompanying drawings in which:—

Figure 1:
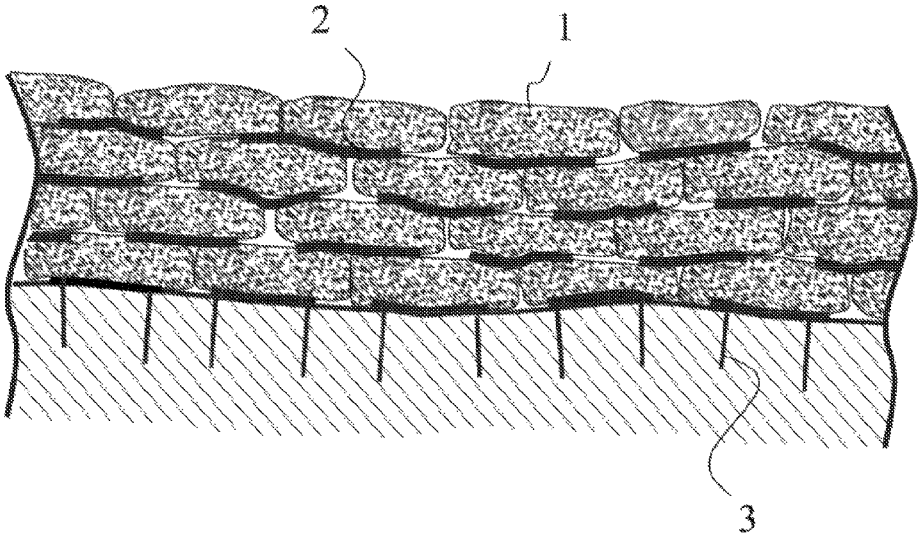
FIG. 1 shows a vertical longitudinal cross-section through a flood barrier formed from sand-bags arranged in layers, reinforced with ties constructed in accordance with the invention.

Referring firstly to FIG. 1, the illustrated barrier is built from sandbags 1 of woven material filled with sand; as is conventional for emergency flood defence purposes. During construction, a layer of ties 2 (to be described later) is placed on the ground and these are pegged into position using steel spikes 3. Bags 1 are then laid, one over each tie, as shown. After laying each layer of bags, ties 2 are placed so that each one bridges across two adjacent bags beneath it.

Figure 2:
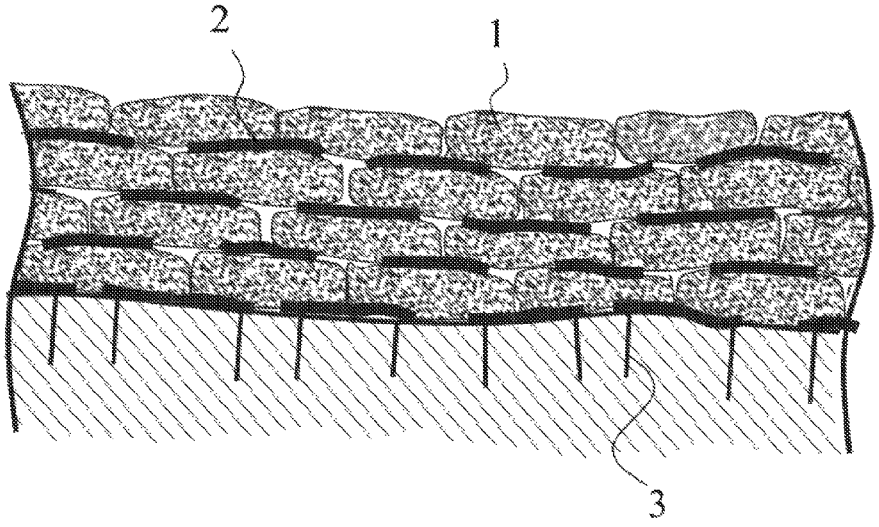
FIG. 2 is similar to FIG. 1 but shows the ties positioned in a different configuration.

In an alternative arrangement shown in FIG. 2, one tie is placed on top of each bag so that it bridges across a pair of overlying bags. The end effect is exactly the same.

Figure 3:
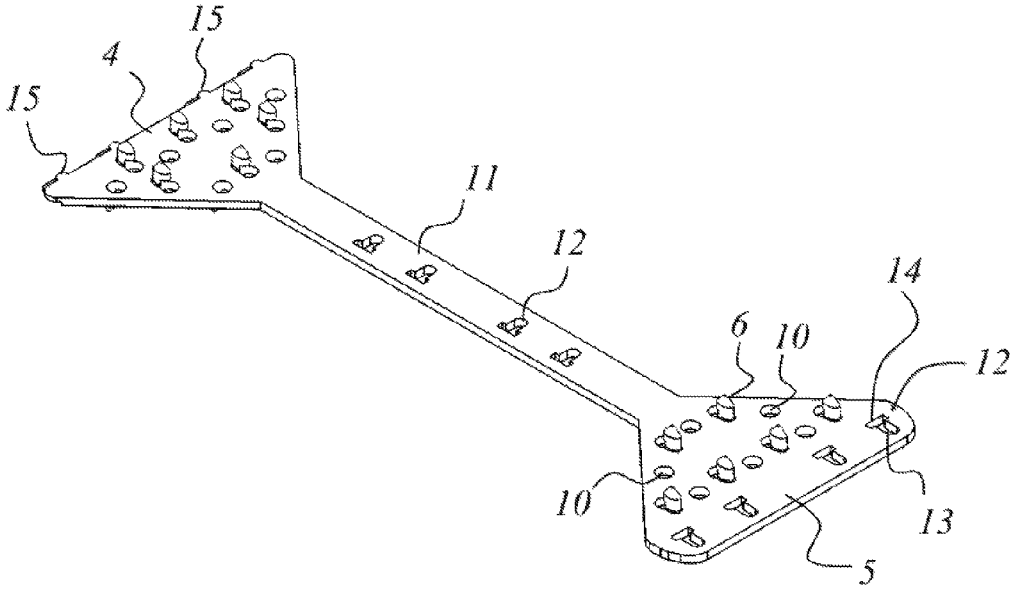
FIG. 3 shows a perspective view of one of the ties as seen from above.
Figure 4:
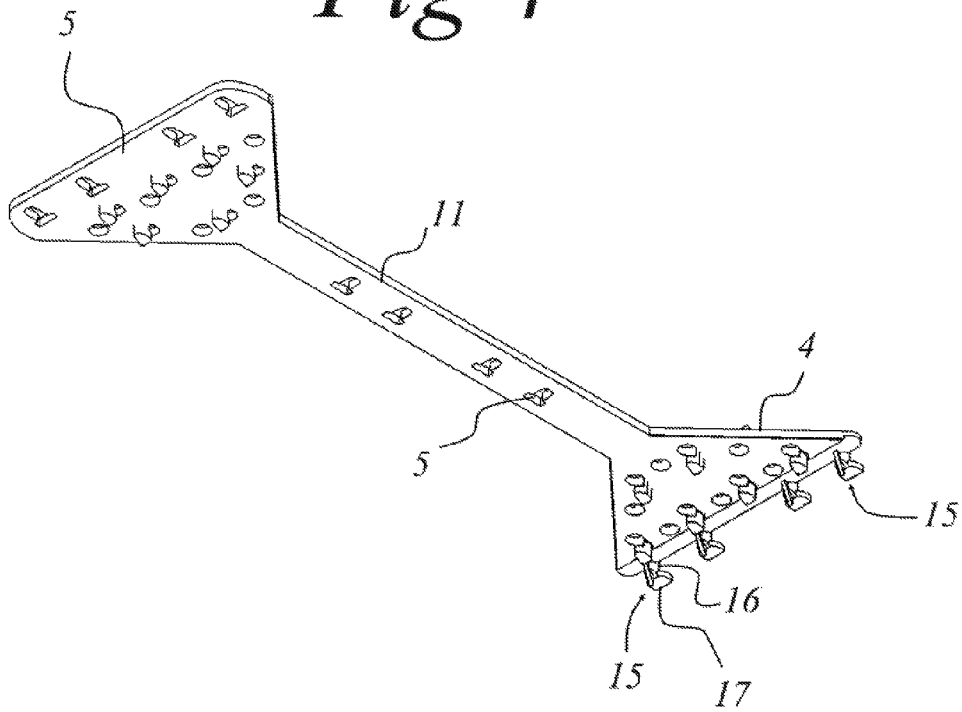
FIG. 4 is similar to FIG. 3 but shows the tie from below.
Figure 5:
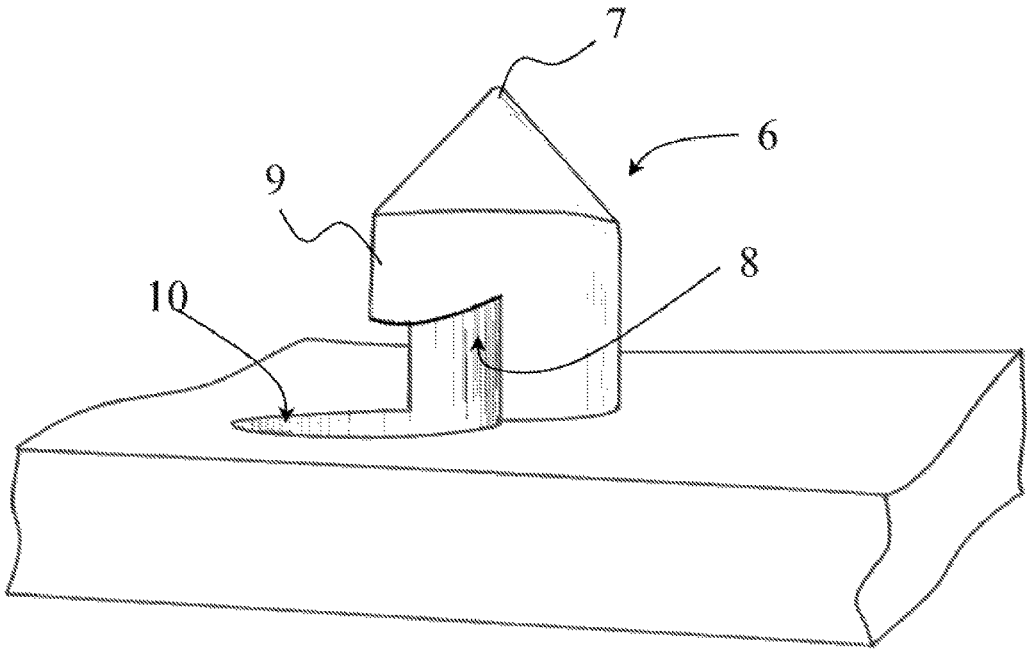
FIG. 5 shows a detailed perspective view of one of the spikes of the tie.

Referring now to FIGS. 3 and 4, each tie 2 is injection moulded as a single piece of recycled synthetic plastics material. It has two rigid triangular end plates 4 and 5. Each plate has an array of spikes 6 projecting from both surfaces, each spike having an elliptical cross-section, the major axis of the ellipse being aligned with the linear axis of the tie. One of these spikes is shown in detail in FIG. 5 which shows its sharp pointed end 7 designed to penetrate the woven fabric of the sacks 1. A recess 8 is formed in each spike. This recess faces towards the centre of the tie and is undercut so as to define a barb 9 that securely retains the spike in the weave of the sack after it has penetrated. The recess 8 is created during the moulding process by a rod on a lower mould plate and this rod also creates holes 10. The holes 10 are used to receive the ground ties 3.

Joining the end plates 4 and 5 is a flexible stem 11. Although relatively narrow (about 22 mms wide) as compared with the plates, this stem has been shown to be capable of withstanding a strain of over one ton whilst having significant flexibility, allowing the tie to conform with the irregular interface between layers of sandbags as shown on FIGS. 1 and 2.

Figure 6:
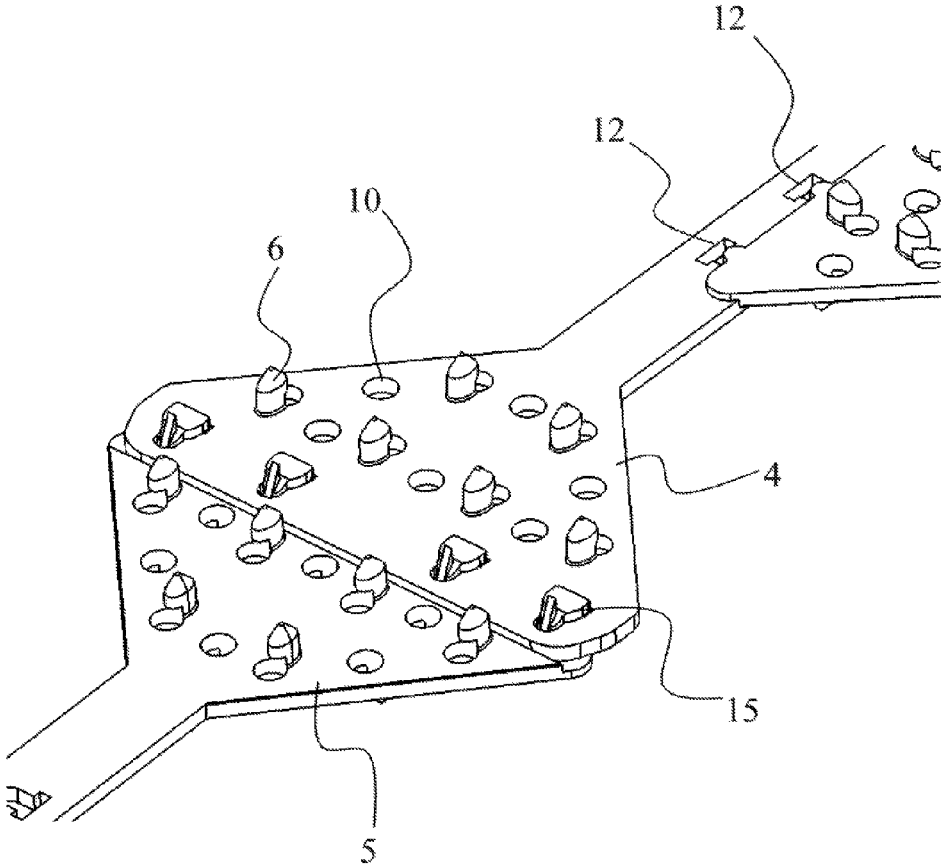
FIG. 6 shows how identical ties can be connected together.

The triangular plate 4 is provided with slots 12 each of which has a narrow part 13 and a wide part 14. The plate 5 has complementary lugs 15 best seen in FIG. 4, each having a narrow part 16 and a wide part 17. By tilting one tie relative to another identical tie it is possible to insert the wide parts of the lugs into the wide parts of the slots. By pulling the ties in a direction away from each other the narrow parts of the lugs will then lock into the narrow parts of the slots to form an oversize tie for use with large sandbags as shown in FIG. 6. Slots 12 are also provided in the stem 11 so that ties (shown broken away on FIG. 6) can be connected at right angles to each other.

In a simple test, where a wheeled digger was used to push against a conventional wall of sandbags, the wall immediately collapsed. In an exactly similar test where the wall had been fitted with ties like that shown in FIG. 2, the wall remained intact, causing the digger wheels to spin without effect.

Of course, the triangular shape of the plates 3 could be replaced by any other convenient shape and it will readily be apparent that many other design variations are possible within the scope of the accompanying claims. Also, there are many variations in the method of use of the tie constructed in accordance with the invention. For example, one end could be permanently built into a permanent wall structure, with the other end protruding so that it is available to tie into any subsequently built extension. Such extension may be temporary and built from sandbags; or may be permanently constructed from masonry materials. The tie according to the invention could also be used in a manner similar to a conventional brick tie, its flexibility allowing accommodation of variation of levels of different layers of bricks or blocks.

Whatever variations of design and use are employed, it is believed that the invention will in a simple, convenient and inexpensive way, allow a significant increase the strength of barriers to be achieved. In sandbag structures it will also allow the use of fewer bags, thus reducing logistical problems, storage requirements and costs. By reducing the number of bags, a critical assembly time advantage can be obtained in those situations where a sandbag structure is needed in an emergency such as for flood defence.

LIST OF REFERENCE NUMERALS

1. sandbag
2. tie
3. ground tie
4. triangular plate
5. triangular plate
6. spike
7. point
8. recess
9. barb
10. hole
11. stem
12. slot
13. narrow part of slot
14. wide part of slot
15. lug
16. narrow part of lug
17. wide part of lug
18. aperture
19. central apertures

The invention claimed is:

1. A barrier formed from filled bags stacked one on top of another and ties having barbed spikes for holding the bags together to strengthen the barrier; wherein each tie has a pair of rigid bag-retention members having an upper and lower face provided with a plurality of barbed spikes, and an elongate connector strap joining the spiked retention members, wherein the connector strap is more flexible than the bag-retention members and the ties are interposed between adjacent rows of filled bags with one face of each of the bag-retention members of a single tie cooperating with one of two adjacent filled bags with the flexible connector strap extending there between while both of the other faces of the pair of bag-retention members of the tie cooperates with a single filled bag in order to limit shifting of the barrier when loaded while enabling limited movement of the filled bags.

2. A barrier according to claim 1 wherein each tie is positioned between layers of bags with the barbed spikes penetrating the bags above and below it respectively.

3. A barrier according to claim 2 comprising ties lying on the ground beneath a bottom layer of the bags and ground ties connecting those ties to the ground.

4. A barrier according to claim 2 wherein each bag-retention member defines a plate formed with spikes.

5. A barrier according to claim 1 comprising ties lying on the ground beneath a bottom layer of the bags and ground ties connecting those ties to the ground.

6. A barrier according to claim 5 wherein each bag-retention member defines a plate formed with spikes.

7. A barrier according to claim 1 wherein each bag-retention member defines a plate formed with spikes.

8. A barrier according to claim 7 in which the plates are molded from synthetic plastics material.

9. A barrier according to claim 8 wherein each tie is formed as a single molding of synthetic plastics material.

* * * * *